United States Patent [19]

Lawrie

[11] Patent Number: 5,072,679

[45] Date of Patent: Dec. 17, 1991

[54] STITCH WIDTH TRACKER FOR SEWING MACHINE

[75] Inventor: George Lawrie, Mississeuga, Canada

[73] Assignee: The Singer Company N.V., Curacao, Netherlands Antilles

[21] Appl. No.: 530,057

[22] Filed: May 29, 1990

[51] Int. Cl.[5] ..... D05B 3/02; D05B 69/00

[52] U.S. Cl. ..... 112/443; 112/221; 112/159; 112/462

[58] Field of Search ..... 112/121.13, 157, 221, 112/443, 462, 464, 463, 159

[56] References Cited

U.S. PATENT DOCUMENTS

| | | | |
|---|---|---|---|
| 2,662,495 | 12/1953 | Parry | 112/221 |
| 3,026,831 | 3/1962 | Johnson | 112/221 |
| 3,089,444 | 5/1963 | Forster et al. | 112/159 |
| 3,727,568 | 4/1973 | Graham | 112/221 |
| 3,783,810 | 1/1974 | Marforio | 112/159 |
| 4,000,706 | 1/1977 | Kreissl et al. | 112/221 |
| 4,178,864 | 12/1979 | Marcandalli | 112/159 |
| 4,188,895 | 2/1980 | Johnson et al. | 112/462 |
| 4,452,157 | 6/1984 | Cantada et al. | 112/221 |

*Primary Examiner*—Werner H. Schroeder
*Assistant Examiner*—Ismael Izaguirre
*Attorney, Agent, or Firm*—Theodore Jay

[57] ABSTRACT

A sewing machine has a vertical needle bar pivotable about a point thereon adjacent the upper end and moveable up and down. A sewing needle is detachably secured to the lower end of the bar and has an eye adjacent its lower end. The machine has an adjustable stitch width and, during its operation at a preset width, satisfies the requirement that the eye must be continuously properly positioned with respect to the machine hook at all times. The eye is vertically aligned with the hook point when the eye is in proximity of the hook, so as to insure reliable stitch formation at any selected stitch width. An arrangement for maintaining such proper positioning employs a first stop secured to the bar at a first location thereon intermediate its ends. A second stop is secured to the bar at a second and lower position intermediate its ends. A member is slidable along and is disposed on the bar in the space between the two stops. A spring is disposed on the bar between the first stop and the member. The member when moved upward to engage the spring causing the spring to exert a force on the first stop which moves the bar upwardly. The amount of upward movement of the bar is monotonically related to the amount of upward movement of the member. A device responsive to the movement of the hook engages the member to move the member upward in such manner as to maintain said proper positioning. The device includes a mechanism for pivoting the needle bar as required for zig zag operation and a stationary element disposed between the second stop and the member.

4 Claims, 2 Drawing Sheets

STITCH WIDTH TRACKER FOR SEWING MACHINE

BACKGROUND OF THE INVENTION

In normal straight line stitching operations employed in sewing machines, the eye of the needle is maintained in vertical alignment with the point of the hook at all times. When zig-zag stitching operations are utilized, this vertical alignment is not maintained, and the needle eye moves upward or downward out of vertical alignment during the pivoting action of the needle bar necessitated for zig-zag operation. While some degree of misalignment can be tolerated, The bight or stitch width obtainable in zig zag sewing machines for home use is limited to a narrow range, typically about six millimenters, because the inconsistencies in the loop forming operation produced because of misalignment become excessive beyond this range.

The present invention overcomes the misalignment problem by causing the needle eye to track with the point of the hook in continous proper vertical alignment during the entire stitching operation, thus eliminating the inconsistencies in the loop forming operation and the resultant narrow bight or stitch width range limitation.

SUMMARY OF THE INVENTION

It is an object of the present invention to provide new and improved apparatus for stitch width control in a zig zag sewing machine which will cause the needle eye and hook point to be properly vertically aligned at all times during a stitching operation.

Another object of the present invention is to provide new and improved apparatus of the character indicated wherein the needle bar is raised or lowered as required during a zig-zag sewing operation in reverse sense to the raising and lowering action which would otherwise occur so that proper vertical alignment of the needle eye and hook point is maintained at all times.

These and other objects and advantages of the invention will either be explained or will become apparent hereinafter.

In accordance with the principles of this invention, a sewing machine is provided with a vertical needle bar pivotable about a point thereon adjacent the upper end and moveable up and down. A sewing needle is detachably secured at one end to the lower end of the bar. The needle has an eye adjacent its other end. The machine has an adjustable stitch width and, as is conventional, is equipped with a hook having a point which cooperates with the eye of the needle to produce the requisite stitching operations.

The machine prior to operation is adjusted for a preset stitch width. In order for stitching operations to be properly carried out, the eye of the needle must be properly vertically aligned with respect to the point of the hook at all times. To this end, the eye must be aligned vertically with the point of the hook when the instantaneous stitch position is zero; the eye must continue to be so aligned when the instantaneous stitch position is positive as well as when the instantaneous stitch is negative.

This invention employs apparatus for moving the needle bar and thus moving the eye of the needle secured to the needle bar in such manner as to satisfy these requirements. The apparatus employs a first stop secured to said bar at a first location thereon intermediate the ends of the bar. A second stop is secured to the bar at a second and lower position intermediate the ends of the bar. A member slidable along the bar is disposed on the bar in the space between the two stops. A spring is disposed on the bar between the first stop and the member.

When the member is moved upward along the bar to engage the spring, the spring is caused to exert a force on the first stop which moves the bar upwardly, the amount of upward movement of the bar being monotonically related to the amount of upward movement of the member.

Means responsive to the movement of the hook engages the member to move the member upward in such manner as to maintain the desired vertical alignment. This means includes the mechanism employed in the machine to pivot the needle bar in the manner required to produce the zig zag stitch and also includes a contoured slide plate disposed between the member and the second stop. The plate is stationary. As the needle bar is pivoted, the second stop and the member engage different regions of the plate contour, causing the member to move and thus exerting a force on the spring.

The force exerted on the spring is minimum when the eye of the needle is disposed at its lowest level below the point of the hook; the force is larger when the eye of the needle is vertically aligned with the point of the hook; and the force is maximum when when the eye of the needle is disposed at its highest level above the point of the hook. The force on the spring changes smoothly and continuously to cause the needle bar to also move smoothly and continuously to maintain proper vertical alignment between the needle eye and the point of the hook at all times, thus eliminating the inconsistencies in the loop forming operations previously encountered when stitch widths were increased beyond the six millimeter range.

DETAILED DESCRIPTION OF PREFERRED EMBODIMENTS

Figure 1:
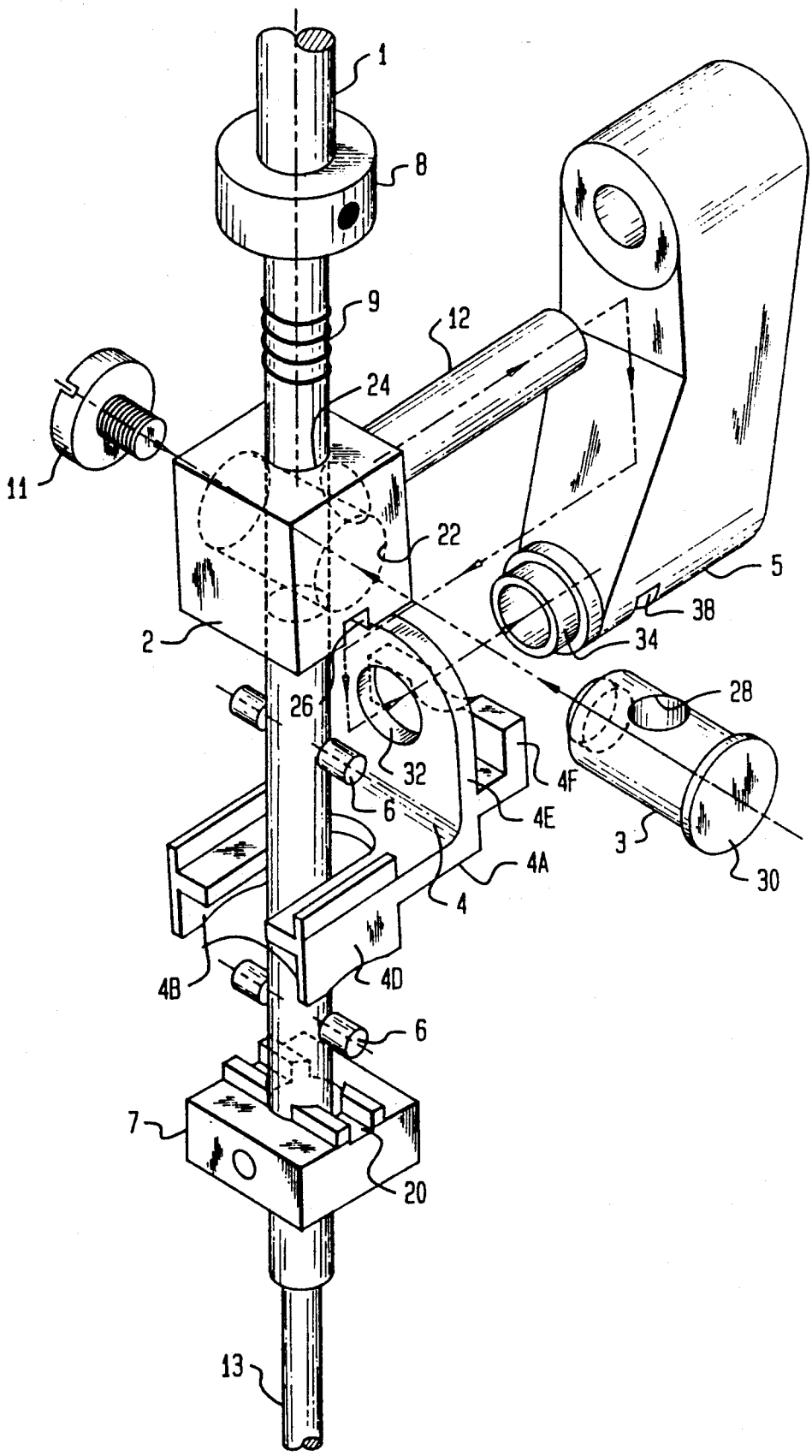
FIG. 1 is a perspective exploded view of a preferred embodiment of the invention.
Figure 2:
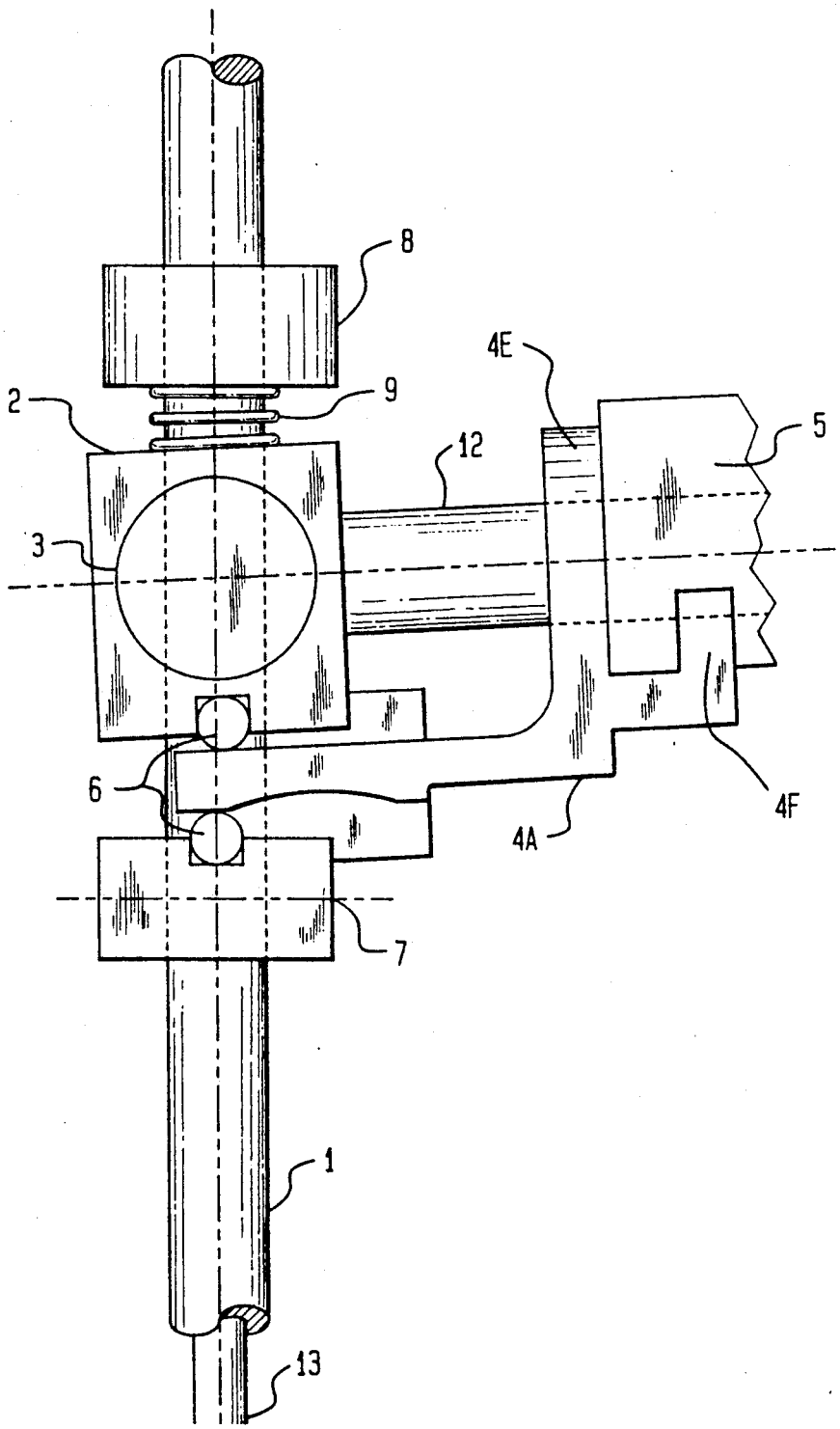
FIG. 2 is side view of the embodiment of FIG. 1 showing a needle bar position shifted out of the instantaneous stitch position of zero.

In FIGS. 1 and 2, the parts and numbers assigned thereto are identified in the table below.

TABLE

| PART INDENTIFICATION | PART NUMBER |
|---|---|
| needle bar | 1 |
| connecting stud | 2 |
| hinge pin | 3 |
| slide plate cam | 4 |
| connecting link | 5 |
| rollers | 6 |
| collar | 7 |
| collar | 8 |
| compression spring | 9 |
| screw for hinge pin | 11 |
| connecting shaft | 12 |
| sewing needle | 13 |

METHOD OF ASSEMBLY

The parts are assembled in the following order. Collar 7 is inserted over the needle bar 1 is locked in position with a set screw. Collar 7 has slots 20 in its upper horizontal surface into which rollers 6 are placed. Connecting stud 2 is hollow, having the shape of a cube and has both vertical and horizontal bores 22 and 24. The bottom horizontal surface of stud 2 carries slots 26 aligned with but vertically spaced from slots 20. Hinge pin 3 is placed into the horizontal bore until the vertical bore 28 in pin 3 is aligned with the vertical bore 24 of stud 2. The pin and stud are then inserted over the needle bar which extends through bores 24 and 28. Screw 11 is then screwed into the end of the hinge pin opposite the end with the enlarged head 30. If necessary, the screw can carry a spring and washer to assist in centering the bore 28 of the pin with respect to the needle bar. Stud 2 is then slid upwards on the needle bar. Rollers 6 are then filled into slots 26 and the horizontal section 4A of the slide plate cam is slid between the rollers, this section having a horizontal slot 4B which accommodates the needle bar. Opposite vertical sides of section 4A have like inclined bottom contoured edges 4D which extend transversely of and engage the rollers in slot 20. These sides have upper parallel horizontal edges which engage the rollers in slots 26. The contour is selected to cause the needle eye to be moved up and down in reverse sense to the needle eye movement which would otherwise occur, thus enabling the arrangement disclosed to maintain the desired vertical alignment of needle eye and hook point previously described.

The compression spring 9 is then slid over the bar 1 to engage the top surface of the stud 2 and collar 8 is then slid over the bar to engage the spring. Collar 8 is locked into place with a set screw.

The slide plate cam has a vertical section 4E with a hole 32 which engages an outer surface of a hollow sleeve 34 at the lower end of connecting link 5. Section 4E has a short horizontal extension with a vertical lip 4F which engages a groove 38 in the bottom of the lower end of link 5. An elongated horizontal shaft 12 is secured at one end to a vertical surface of stud 2 and extends at right angles to bore 22. The other end of the shaft extends into the interior of sleeve 34.

The head end of the needle bar and link 5 are then connected in place with the remainder of the sewing machine. The needle bar is pivoted at a point above the collar 8 and below the upper end of the bar in conventional manner. The bar is mounted in known manner so that it can be moved upward or downward to the extent necessary for zig-zag action. The link 5 is secured to the conventional mechanism which produces the pivoting action of the bar for the purpose of zig-zag stitching. Needle 13 is inserted in the lower end of the needle bar and is threaded in conventional manner.

OPERATION

The preferred embodiment is designed to function to a selected maximum bight of sixteen millimeters. In practice, when a stitch width in excess of six millimeters is to be used, the stitch width is covered using a number of stitches to insure retention of the thread.

When the mechanism connected to link 5 causes the bar to pivot, the connecting stud 2 moves with the bar. However, the connecting shaft 12, while moving with the stud, holds it in vertical position. The end of shaft 12 moves back and forth within sleeve 34 but always remains therein. The diameters of bores 34 and 38 are somewhat larger than the diameter of the needle bar to provide enough clearance for this action as shown in FIG. 2. During the pivoting action, the slide plate cam remains stationary, but the displacement of the stud 2 and the collar 7 causes the rollers 6 to have different positions of engagement with horizontal section 4A. This causes the stud 2 to move up and down along the bar, depending upon the direction and extent of pivot. The movement is translated by the spring 9 against the collar 8 to move the needle up and down. The spring 9 and the collar 8 insures that the rollers always engage the section 4A. It is only when the bar 1 is in the return stroke that an external load is exerted on the spring 9. The contour of edges 4D establishes the desired monotonic relationship between needle eye and hook point.

The profile of the horizontal section 4A will vary, depending upon the needle bar configuration, and the invention can be used in both rotary hook and shuttle applications.

While the invention has been described with particular reference to the preferred embodiment, the protection sought is to be limited only by the terms of the claims which follow.

What is claimed is:

1. A sewing machine having a vertical needle bar pivotable about a point thereon adjacent an upper end thereof and moveable up and down, a sewing needle detachably secured at one end to a lower end of the bar, and having an eye adjacent the other end, and a hook having a point, the machine having an adjustable stitch width, an arrangement for vertically aligning the eye properly with respect to the hook at all times during an operation of the machine at a present width, so that the eye is vertically aligned with the hook point when the eye is in proximity of the hook at all times, said arrangement comprising:

a first stop secured to said bar at a first location thereon intermediate the ends of the bar;

a second stop secured to the bar at a second and lower position intermediate the ends of the bar;

a member slidable along the bar and disposed on the bar in a space between the two stops;

a spring disposed on the bar between the first stop and the member, the member being moved upward to engage the spring so that the spring exerts a force on the first stop which moves the bar upwardly, the amount of upward movement of the bar being equally related to the amount of upward movement of the member; and means responsive to the movement of the hook and engaging the member to move the member upward in such manner as to maintain said proper vertical alignment of needle eye and hook point, said means including a mechanism for pivoting the needle bar as required for a zig zag operation and a stationary element disposed between the second stop and the member.

2. The arrangement of claim 1 wherein said element includes a contoured slide plate which extends between the second stop and the member.

3. The arrangement of claim 2 wherein said plate has a slot through which the bar extends.

4. The arrangement of claim 3 wherein adjacent surfaces of the second stop and said member have roller means engaged by the plate.

* * * * *